US008442238B2

(12) United States Patent
Franzén

(10) Patent No.: US 8,442,238 B2
(45) Date of Patent: May 14, 2013

(54) DEVICE IN A HEADSET

(76) Inventor: Bo Franzén, Nybro (SE)

( * ) Notice: Subject to any disclaimer, the term of this patent is extended or adjusted under 35 U.S.C. 154(b) by 589 days.

(21) Appl. No.: 12/337,469

(22) Filed: Dec. 17, 2008

(65) Prior Publication Data

US 2009/0136056 A1 May 28, 2009

Related U.S. Application Data

(63) Continuation of application No. PCT/SE2007/050469, filed on Jun. 26, 2007.

(51) Int. Cl.
*G10K 11/16* (2006.01)

(52) U.S. Cl.
USPC ..... 381/71.6; 381/72; 381/94.7; 381/315; 455/575.2

(58) Field of Classification Search ..... 381/23.1, 381/26, 28, 324, 328, 329, 72, 73.1, 74, 84, 381/93, 94.1, 312, 317, 318, 321, 322, 326, 381/325, 71.6, 71.7, 71.11, 71.12, 71.13, 381/77, 79, 80, 83, 334, 91, 92, 94.5, 94.7, 381/95, 97, 98, 100, 103, 104, 106, 111, 381/122, 314, 315, 316, 320, 73, 1, 370, 381/313; 455/575.2, 575.8, 575.9
See application file for complete search history.

(56) References Cited

U.S. PATENT DOCUMENTS

| | | | | |
|---|---|---|---|---|
| 5,631,965 | A * | 5/1997 | Chang et al. | 381/72 |
| 5,717,818 | A * | 2/1998 | Nejime et al. | 704/211 |
| 2003/0223612 | A1 * | 12/2003 | Knorr et al. | 381/370 |
| 2005/0033571 | A1 | 2/2005 | Huang et al. | |

FOREIGN PATENT DOCUMENTS

| | | | |
|---|---|---|---|
| JP | 2000-013883 | A | 1/2000 |
| JP | 2000-102087 | A | 4/2000 |
| JP | 2003-082521 | A | 3/2003 |
| WO | WO 2005025268 | A1 * | 3/2005 |

OTHER PUBLICATIONS

International Search Report, 1 page (Nov. 7, 2007).

* cited by examiner

*Primary Examiner* — Vivian Chin
*Assistant Examiner* — Leshui Zhang
(74) *Attorney, Agent, or Firm* — The Maxham Firm

(57) ABSTRACT

A device in a headset having a throat microphone and ear speakers soundproofing against the auditory meatus. The device has a separate microphone connected to the ear speaker for picking up the sound of the surroundings that is transmitted to the car speaker. Furthermore, noise-suppressing means are included, which limit the sound level of the sound of the surroundings. The throat microphone communicates via a communication unit. The soundproofing ear speaker and the microphone are arranged so that the headset can be housed in a safety helmet.

11 Claims, 2 Drawing Sheets

DEVICE IN A HEADSET

FIELD OF THE INVENTION

The present invention relates to a device in a headset having a throat microphone combined with an ear speaker soundproofing against the auditory meatus, in order to be able to listen to traffic sound.

BACKGROUND OF THE INVENTION

Today, soundproofing ear speakers are used for the introduction into the ear according to U.S. Pat. No. 7,639,824, so as to shut out surrounding sound. These become essentially soundproof, there being needs to perceive desirable traffic sounds in order to assess the traffic situation over time. According to prior art, microphones have been built-in into noise-suppressing ear speakers that cover the entire external ear. Via an amplifier, the sound of the surroundings is amplified inside the earmuff speaker to a predetermined adjustable level that does not exceed the established level that may cause hearing damage. Such earmuffs covering the ear become expensive, heavy, complicated bulky, and are heavy, warm, ungainly and expensive, and can therefore not be accommodated in a motorcyclist's helmet or another safety helmet.

SUMMARY OF THE INVENTION

A purpose of the present invention is to obviate problems of the type mentioned above.

According to embodiments of the invention, the purpose set forth is attained by the fact that a device of the kind mentioned by way of introduction comprises the special features that the device comprises at least one separate microphone connected to the ear speaker for picking up the sound of the surroundings, such as, for example, traffic noise, that is transmitted to the ear speaker in the headset, the device furthermore comprising a noise-suppressing means arranged to allow the wearer of the headset via said separate microphone to listen only to the part of the sound of the surroundings that is not on a harmful sound level, wherein the throat microphone can communicate via at least one communication unit, the soundproofing ear speaker and the separate microphone being arranged so that the headset can be housed in a motorcyclist's helmet or another safety helmet.

Thanks to the invention, now there has been provided, in a headset having a throat microphone, wherein combined with a soundproofing ear speaker for the introduction into the ear, according to the invention it being possible to mount microphones connected to the ear speakers, for example, the outer parts thereof, which gives a simple and easy-to-mount hearing-protecting function, electronics associated with the function can be accommodated in the ear speakers of the headset, in the other parts of the headset, or in an external unit connected via cable or "Bluetooth." Said external unit can also be a mobile telephone, wireless telephone or a communication radio or another type of electronics.

According to the invention, the problem of ungainly ear speakers has now been solved, the user obtaining a more practical and easy-to-use construction, which occupies a minimum of space. By supplementing the soundproofing earphone receiver with a separate microphone that is connected to the same, thereby picking up traffic noise and transmitting it to the earphone receiver in the headset. That is, combined with the soundproofing throat microphone it is possible, by means of this concept, to communicate via a simple communication unit like the one according to the invention, wherein the same can be housed in a motorcyclist's helmet or another safety helmet. Furthermore, the invention gives an unsurpassed ear protection at the same time as it is possible to listen to the part of the sound of the surroundings that is not harmful but that is necessary to hear from a safety point of view.

Thus, embodiments of the invention solve the problem of, on one hand, communicating with another person, that is, transmitting as well as receiving speech signals without the same being disturbed by irrelevant ambient noise such as traffic sound, and on the other hand, in a controlled way, receiving such ambient noise without it appreciably disturbing the communication but allowing information related to such a noise, for instance traffic information.

According to a preferred embodiment, the microphone and/or the noise-suppressing means are/is arranged in the ear speaker. Thereby, the device becomes simple and compact.

According to an alternative embodiment, the microphone and/or the noise-suppressing means are/is arranged in a separate external unit connected to the ear speaker via a cable or via wireless signal transfer. This alternative allows increased flexibility when used and requires a minimum of equipment in the proper ear speaker.

According to an additional embodiment, the throat microphone is connected to a transmitter in order to transmit speech signals, and the ear speaker is connected to a receiver in order to receive speech signals. By this arrangement, an efficient means of communicating with other persons is attained without it being disturbed by irrelevant external noise.

According to another embodiment, the throat microphone and the ear speaker are connected to each other solely via cables. This contributes further to the fact that the device becomes minimally space-requiring and easy to use together with a safety helmet.

According to yet another embodiment, the ear speaker has a funnel-shaped part arranged for the introduction into the auditory meatus of the user, which funnel-shaped part has outer limiting surfaces arranged to soundproof against the walls of the auditory meatus. Thereby, sound coming from outside is essentially blocked from directly penetrating into the auditory meatus but only via the special microphone and the appurtenant sound-absorbing means. Thereby, the communication with another person can be made without being heavily disturbed by the sound coming from outside.

According to an additional embodiment, the throat microphone has a sealing flange in order to seal against the skin around the throat. Thereby, disturbances from the sound coming from outside are reduced when the user speaks and transmits speech signals.

According to a further embodiment, the throat microphone has a capsule in which a microphone directed toward the skin around the throat is embedded in surrounding silicone. This contributes further to shut out the sound coming from outside when the user transmits speech signals.

According to an additional embodiment, the throat microphone is attached in a loop, arranged to partly surround the neck of the user. This entails an efficient and simple way to keep the throat microphone in place.

According to another embodiment, the loop is resilient. It entails increased security as for to keep the throat microphone in place.

BRIEF DESCRIPTION OF THE DRAWING

The invention is further described below by means of the subsequent detailed description of advantageous embodiment examples of the invention, reference being made to accompanying drawings, wherein.

DETAILED DESCRIPTION OF THE PREFERRED EMBODIMENTS

Figure 1:
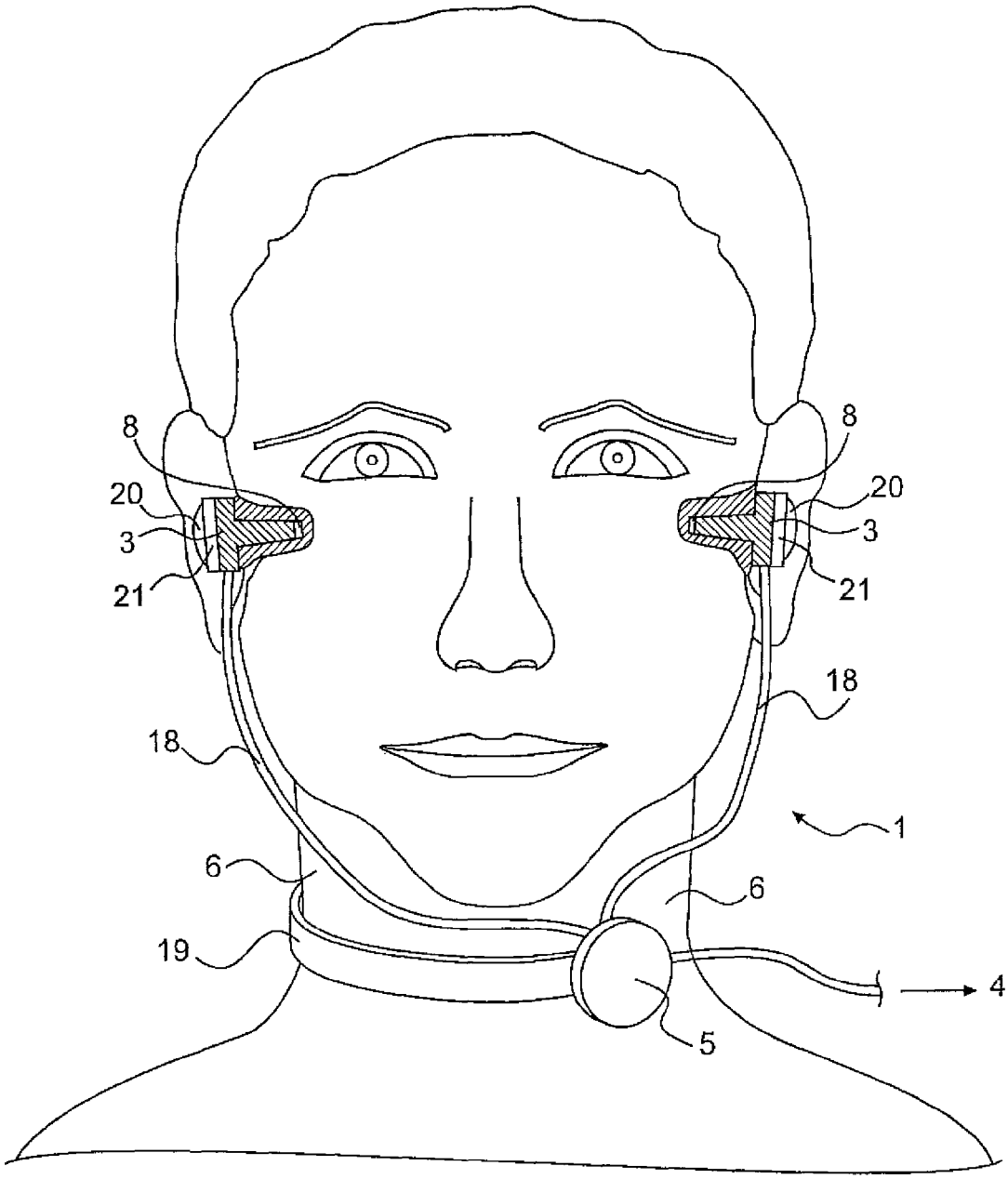
FIG. 1 shows a partly screened perspective view of a person's head carrying a headset.

As is seen from FIG. 1, a person is shown equipped with a noise-suppressing headset 1, which has two ear speakers 3 that are introduced into the auditory meatuses 8, the same being attached in a soundproofing way, so that the sound coming from outside does not penetrate into the auditory meatus 8. A throat microphone 5 abuts against the skin around the throat 6 and is connected via the cables 18 to a transceiver 4. The throat microphone 5 is attached in a loop 19. The abutment against the throat 6 soundproofs against the sound coming from outside from penetrating into the throat microphone 5.

Figure 2A:
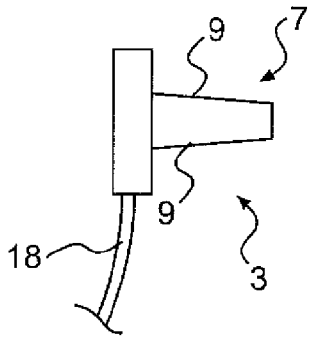
FIGS. 2*a*)-2*c*) show in partial FIG. 2*a*) an earphone receiver having a funnel-shaped part, in a side view before the funnel-shaped part is introduced into the auditory meatus; in partial FIG. 2*b*), the funnel-shaped part is shown in a vertical section, after it is introduced into the auditory meatus; and partial FIG. 2*c*) shows an alternative embodiment of the funnel-shaped part in a side view before it is introduced into the auditory meatus.
Figure 2B:
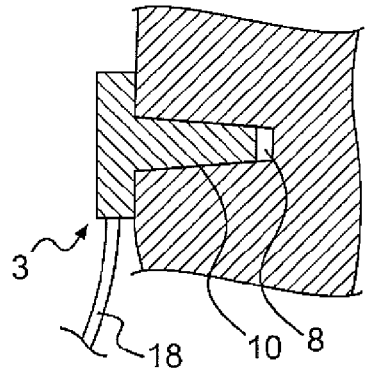
Figure 2C:
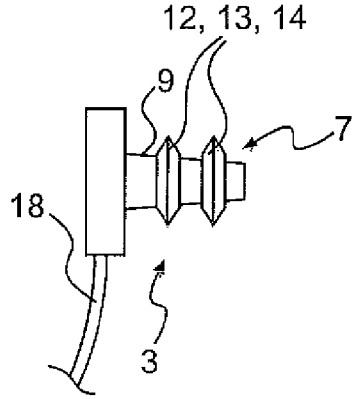

In FIG. 2*a*), the earphone receiver 3 is shown having a funnel-shaped part 7 having outer limiting surfaces 9 that should soundproof against the walls 10 of the auditory meatus 8. In FIG. 2*b*), the car speaker 3 is shown when it is introduced into the auditory meatus 8. In FIG. 2*c*), the limiting surfaces 9 are supplemented with surrounding flanges 12, which consist of a soundproofing gasket 13 or which consist of a retention element 14.

Figure 3:
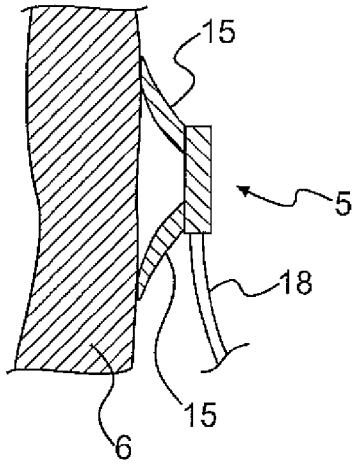
FIG. 3 shows a throat microphone in a vertical section that abuts against the skin around a throat.
Figure 4:
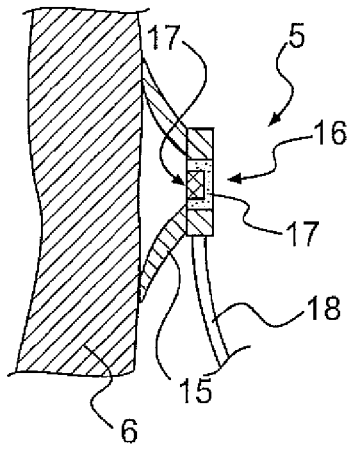
FIG. 4 shows a throat microphone in a vertical section that abuts against the skin around a throat with a directed microphone.

In FIG. 3, the throat microphone 5 is shown having a sealing flange 15 for improved sealing against the skin around a throat 6. In FIG. 4, the throat microphone 5 is shown made with a capsule 16, in which a microphone 17 directed toward the skin around the throat 6 is embedded in surrounding silicone.

As is seen in FIG. 1, a microphone 20 is connected to each ear speaker. The microphone 20 is arranged to receive sound coming from outside, e.g., traffic noise. In connection with the microphone 20, there is a sound-absorbing device 21 that damps sound entering through the microphone 20 so that the sound is limited to a fixed decibel level. The sound signals from the microphone 20 are transmitted to the two ear speakers 3. Thereby, the person can receive sound impressions from the surroundings in a controlled way so that the same do not disturb the sound signals communicated to the ear speakers 3 via the communication equipment. Suitably, the sound-absorbing device is adjustable so that it is possible to set the allowable decibel level.

In the example shown, the microphone 20 and the sound-absorbing device are connected to the ear speakers 3. Alternatively, the same can be connected to the cables 18. Another option is to arrange the microphone and/or the sound-absorbing device in a separate unit that via cable or in a wireless manner, for example, of the type "Bluetooth," transmits the signals to the headset.

What is claimed is:

1. A communication unit having a headset configured to be mounted on a head of a human being user, the user's head comprising at least one ear having a peripheral portion at least partially surrounding an auditory meatus extending into the user's head, the at least one ear having external portions projecting outwardly from a side of the user's head by a limited distance, the headset comprising:

a throat microphone;

at least one ear speaker coupled to said throat microphone for communication therewith and to enable audible communications with other communication units, said at least one ear speaker being configured to be inserted partially into the auditory meatus and projecting outwardly therefrom by a distance less than the limited distance, said at least one ear speaker being configured to fit in the auditory meatus in a manner to be generally soundproof with respect to external sounds entering the auditory meatus;

an ear speaker microphone mounted to said at least one ear speaker and configured to receive sounds external to said at least one ear speaker, the combination said at least one ear speaker and said ear speaker microphone projecting outwardly from the user's head no more than approximately the limited distance; and a noise-suppressing means connected to said ear speaker microphone to limit the external sounds transmitted to the user's auditory meatus to a fixed decibel level that does not interfere with audible communications while permitting ambient sound to be heard by the user.

2. The communication unit according to claim 1, and further comprising a separate external unit connected to said at least one ear speaker by a means selected from the group consisting of a cable and a wireless signal transfer, at least one of a separate microphone and a noise-suppressing means being arranged in the external unit.

3. The communication unit according to claim 2, and further comprising:

a transmitter to transmit speech signals, said throat microphone being connected to said transmitter; and a receiver to receive speech signals, said at least one ear speaker being connected to said receiver.

4. The communication unit according to claim 2, wherein said at least one ear speaker is formed with a funnel-shaped part arranged to fit into the auditory meatus of the ear, said funnel-shaped part having outer limiting surfaces configured to soundproof against walls of the auditory meatus.

5. The communication unit according to claim 1, and further comprising:

a transmitter to transmit speech signals, said throat microphone being connected to said transmitter; and a receiver to receive speech signals, said at least one ear speaker being connected to said receiver.

6. The communication unit according to claim 1, wherein said at least one ear speaker is formed with a funnel-shaped part arranged to fit into the auditory meatus of the ear, said funnel-shaped part having outer limiting surfaces configured to soundproof against walls of the auditory meatus.

7. The communication unit according to claim 6, wherein said funnel-shaped part is formed with at least one surrounding flange which functions as at least one of a soundproofing gasket and a retention element.

8. The communication unit according to claim 1, wherein said throat microphone is formed with a sealing flange which seals against the user's skin around the user's throat.

9. The communication unit according to claim 1, wherein said throat microphone has a capsule in which said throat microphone is directed toward a portion of the user's skin around the user's throat and is embedded in silicone.

10. The communication unit according to claim 1, and further comprising a loop to which said throat microphone is attached, said loop being configured to at least partly surround the user's neck.

11. The communication unit according to claim 10, wherein the loop is resilient.

* * * * *